US007398038B2

(12) United States Patent
Tsuda et al.

(10) Patent No.: US 7,398,038 B2
(45) Date of Patent: Jul. 8, 2008

(54) IMAGE FORMING APPARATUS USING A TONER CONTAINER AND A PROCESS CARTRIDGE

(75) Inventors: Kiyonori Tsuda, Kanagawa (JP); Hiroshi Hosokawa, Kanagawa (JP); Masanori Kawasumi, Kanagawa (JP); Satoshi Narumi, Kanagawa (JP); Ryuta Takeichi, Kanagawa (JP); Kazuhiko Umemura, Shizuoka (JP); Yuji Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 568 days.

(21) Appl. No.: 10/667,301

(22) Filed: Sep. 23, 2003

(65) Prior Publication Data

US 2005/0226656 A1 Oct. 13, 2005

(51) Int. Cl.
*G03G 15/08* (2006.01)

(52) U.S. Cl. ..... 399/262; 399/258

(58) Field of Classification Search ..... 399/119, 399/254, 258, 262; 222/DIG. 1
See application file for complete search history.

(56) References Cited

U.S. PATENT DOCUMENTS

| | | | | |
|---|---|---|---|---|
| 4,878,603 | A | 11/1989 | Ikesue et al. | |
| 5,441,177 | A | 8/1995 | Yanagisawa | |
| 5,455,662 | A | 10/1995 | Ichikawa et al. | |
| 5,557,382 | A | 9/1996 | Tatsumi et al. | |
| 5,648,840 | A | 7/1997 | Ikunami et al. | |
| 5,659,860 | A | 8/1997 | Sasaki et al. | |
| 5,722,014 | A | 2/1998 | Fike | |
| 5,722,019 | A * | 2/1998 | Nakajima | 399/262 |
| 5,754,916 | A * | 5/1998 | Kitayama et al. | 222/DIG. 1 X |
| 5,758,235 | A | 5/1998 | Kosuge et al. | |
| 5,765,059 | A | 6/1998 | Kosuge et al. | |
| 5,765,079 | A | 6/1998 | Yoshiki et al. | |
| 5,768,664 | A | 6/1998 | Kosuge et al. | |
| 5,774,773 | A * | 6/1998 | Otsuka et al. | 399/262 |

(Continued)

FOREIGN PATENT DOCUMENTS

| | | |
|---|---|---|
| EP | 0 435 596 | 7/1991 |

(Continued)

OTHER PUBLICATIONS

U.S. Appl. No. 09/947,391, filed Sep. 7, 2001, Kawagoe et al.

(Continued)

*Primary Examiner*—Sandra L Brase
(74) *Attorney, Agent, or Firm*—Oblon, Spivak, McClelland, Maier & Neustadt, P.C.

(57) ABSTRACT

An image forming apparatus of the present invention includes a process cartridge including a developing device that includes a developer carrier and a toner storing portion storing toner for replenishment. The developer carrier conveys a developer deposited thereon to a developing zone where the developer carrier faces and image carrier. The developing device feeds the toner from the toner storing portion to the developer carrier or the developer deposited on the developer carrier. A toner container stores toner to be replenished to said the storing section. The process cartridge and toner container each are removably mounted to the apparatus independently of each other. A toner conveying device configured to convey the toner from toner container to toner storing portion by using the weight of the toner is mounted on the image forming apparatus.

23 Claims, 13 Drawing Sheets

U.S. PATENT DOCUMENTS

| | | | | |
|---|---|---|---|---|
| 5,794,108 | A | 8/1998 | Yoshizawa et al. | |
| 5,828,935 | A | 10/1998 | Tatsumi et al. | |
| 5,890,040 | A * | 3/1999 | Matsuoka et al. | 399/262 |
| 5,909,610 | A | 6/1999 | Yoshiki et al. | |
| 5,913,097 | A | 6/1999 | Nakano et al. | |
| 5,915,155 | A | 6/1999 | Shoji et al. | |
| 5,966,574 | A | 10/1999 | Ui et al. | |
| 5,970,290 | A | 10/1999 | Yoshiki et al. | |
| 6,104,900 | A | 8/2000 | Ishikawa et al. | |
| 6,118,951 | A | 9/2000 | Kato et al. | |
| 6,125,243 | A | 9/2000 | Shoji et al. | |
| 6,141,520 | A | 10/2000 | Kosuge | |
| 6,163,666 | A | 12/2000 | Hosokawa et al. | |
| 6,185,401 | B1 | 2/2001 | Kanamori et al. | |
| 6,198,895 | B1 | 3/2001 | Tsuda et al. | |
| 6,212,343 | B1 | 4/2001 | Hosokawa et al. | |
| 6,256,469 | B1 | 7/2001 | Tanayama et al. | |
| 6,266,501 | B1 | 7/2001 | Mizuishi et al. | |
| 6,289,195 | B1 | 9/2001 | Ichikawa et al. | |
| 6,336,020 | B1 | 1/2002 | Ishikawa et al. | |
| 6,337,957 | B1 | 1/2002 | Tamaki et al. | |
| 6,363,237 | B1 | 3/2002 | Nagame et al. | |
| 6,366,755 | B1 * | 4/2002 | Takashima | 399/254 |
| 6,393,241 | B1 | 5/2002 | Matsumoto et al. | |
| 6,447,973 | B1 | 9/2002 | Asami et al. | |
| 6,493,529 | B1 | 12/2002 | Umemura et al. | |
| 6,501,913 | B2 | 12/2002 | Hattori et al. | |
| 6,507,720 | B2 | 1/2003 | Kabumoto et al. | |
| 6,521,386 | B1 | 2/2003 | Sakon et al. | |
| 6,522,855 | B1 | 2/2003 | Katoh et al. | |
| 6,558,862 | B2 | 5/2003 | Kojima et al. | |
| 6,560,431 | B2 | 5/2003 | Hosokawa | |
| 6,562,529 | B1 | 5/2003 | Kojima et al. | |
| 6,567,637 | B2 | 5/2003 | Yanagisawa et al. | |
| 6,591,077 | B2 | 7/2003 | Yanagisawa et al. | |
| 6,615,013 | B2 | 9/2003 | Arai et al. | |
| 6,628,908 | B2 | 9/2003 | Matsumoto et al. | |
| 6,665,508 | B2 | 12/2003 | Sudo et al. | |
| 6,775,503 | B2 | 8/2004 | Hattori et al. | |
| 6,826,381 | B2 | 11/2004 | Muramatsu et al. | |
| 6,898,407 | B2 | 5/2005 | Noguchi et al. | |
| 6,937,838 | B2 | 8/2005 | Ishii et al. | |
| 7,043,173 | B2 | 5/2006 | Grune et al. | |
| 2002/0102112 | A1 | 8/2002 | Hung-Hsu | |
| 2002/0102113 | A1 | 8/2002 | Kusano et al. | |
| 2003/0116923 | A1 | 6/2003 | Meetze et al. | |
| 2003/0117892 | A1 | 6/2003 | Litwiller | |
| 2003/0156861 | A1 | 8/2003 | Nagano et al. | |
| 2004/0009015 | A1 | 1/2004 | Fujimori et al. | |
| 2004/0096239 | A1 | 5/2004 | Hosokawa et al. | |
| 2004/0126150 | A1 | 7/2004 | Noguchi et al. | |
| 2004/0131381 | A1 | 7/2004 | Kawasumi et al. | |
| 2004/0165913 | A1 | 8/2004 | Hattori | |
| 2004/0170446 | A1 | 9/2004 | Nagashima et al. | |
| 2004/0170447 | A1 | 9/2004 | Arai et al. | |
| 2004/0184841 | A1 | 9/2004 | Tsuda et al. | |
| 2004/0208676 | A1 | 10/2004 | Ishii et al. | |
| 2004/0223790 | A1 | 11/2004 | Hosokawa et al. | |
| 2004/0240908 | A1 | 12/2004 | Deguchi et al. | |
| 2004/0258432 | A1 | 12/2004 | Hattori et al. | |
| 2004/0265011 | A1 | 12/2004 | Tsuda et al. | |
| 2005/0008393 | A1 | 1/2005 | Kuma et al. | |
| 2005/0008398 | A1 | 1/2005 | Hattori | |
| 2005/0036810 | A1 | 2/2005 | Murakami et al. | |
| 2005/0084293 | A1 | 4/2005 | Fukuchi et al. | |
| 2005/0158071 | A1 | 7/2005 | Hosokawa et al. | |
| 2005/0169653 | A1 | 8/2005 | Noguchi et al. | |

FOREIGN PATENT DOCUMENTS

| | | |
|---|---|---|
| EP | 0 616 268 | 9/1994 |
| EP | 0 779 561 | 6/1997 |
| EP | 0 801 337 | 10/1997 |
| EP | 1 022 620 | 7/2000 |
| EP | 1 120 691 | 8/2001 |
| EP | 1 220 051 | 7/2002 |
| JP | 60-146265 | 8/1985 |
| JP | 4-477 | 1/1992 |
| JP | 4-123074 | 4/1992 |
| JP | 06-59576 | 3/1994 |
| JP | 6-110331 | 4/1994 |
| JP | 06-266227 | 9/1994 |
| JP | 07-20705 | 1/1995 |
| JP | 07-043999 | 2/1995 |
| JP | 08-137176 | 5/1996 |
| JP | 9-90727 | 4/1997 |
| JP | 9-160364 | 6/1997 |
| JP | 09-251240 | 9/1997 |
| JP | 09-311535 | 12/1997 |
| JP | 10-63084 | 3/1998 |
| JP | 10-142913 | 5/1998 |
| JP | 11-184232 | 7/1999 |
| JP | 2000-105494 | 4/2000 |
| JP | 2000-172058 | 6/2000 |
| JP | 2000-172059 | 6/2000 |
| JP | 2000-187378 | 7/2000 |
| JP | 2000-221766 | 8/2000 |
| JP | 2000-275941 | 10/2000 |
| JP | 3120723 | 10/2000 |
| JP | 2000-310901 | 11/2000 |
| JP | 2000-338758 | 12/2000 |
| JP | 2001-5286 | 1/2001 |
| JP | 2001-27839 | 1/2001 |
| JP | 2001-125359 | 5/2001 |
| JP | 2001-265102 | 9/2001 |
| JP | 2002-6601 | 1/2002 |
| JP | 2002-139905 | 5/2002 |
| JP | 2002-169365 | 6/2002 |
| JP | 2002-221858 | 8/2002 |
| JP | 2002-244359 | 8/2002 |
| JP | 2002-268295 | 9/2002 |
| JP | 2002-268357 | 9/2002 |
| JP | 2002-276466 | 9/2002 |
| JP | 2002-357945 | 12/2002 |
| JP | 3384914 | 12/2002 |
| JP | 2004-139031 | 5/2004 |

OTHER PUBLICATIONS

U.S. Appl. No. 10/059,240, filed Jan. 31, 2002, Sugiura et al.
U.S. Appl. No. 10/059,239, filed Jan. 31, 2002, Mochizuki et al.
U.S. Appl. No. 10/092,488, filed Mar. 8, 2002, Arai et al.
U.S. Appl. No. 10/107,157, filed Mar. 28, 2002, Masuda et al.
U.S. Appl. No. 10/153,627, filed May 24, 2002, Suzuki et al.
U.S. Appl. No. 10/212,736, filed Aug. 7, 2002, Sugiura et al.
U.S. Appl. No. 10/318,109, filed Dec. 13, 2002, Sugiura et al.
U.S. Appl. No. 10/352,075, filed Jan. 28, 2003, Kojima et al.
U.S. Appl. No. 10/376,355, filed Mar. 3, 2003, Kojima et al.
U.S. Appl. No. 10/418,111, filed Apr. 18, 2003, Kawahara et al.
U.S. Appl. No. 10/667,301, filed Sep. 23, 2003, Tsuda et al.
U.S. Appl. No. 11/220,845, filed Sep. 8, 2005, Tsuda et al.
U.S. Appl. No. 11/247,269, filed Oct. 12, 2005, Uchiyama et al.
U.S. Appl. No. 11/287,421, filed Nov. 28, 2005, Uchitani et al.
U.S. Appl. No. 11/287,305, filed Nov. 28, 2005, Hosokawa et al.
U.S. Appl. No. 11/567,548, filed Dec. 6, 2006, Taguchi, et al.
U.S. Appl. No. 11/567,601, filed Dec. 6, 2006, Taguchi, et al.
U.S. Appl. No. 11/566,882, filed Dec. 5, 2006, Taguchi, et al.
U.S. Appl. No. 11/566,897, filed Dec. 5, 2006, Taguchi, et al.
U.S. Appl. No. 11/567,589, filed Dec. 6, 2006, Taguchi, et al.
U.S. Appl. No. 11/566,828, filed Dec. 5, 2006, Taguchi, et al.
U.S. Appl. No. 11/566,852, filed Dec. 5, 2006, Taguchi, et al.
U.S. Appl. No. 11/567,568, filed Dec. 6, 2006, Taguchi, et al.
U.S. Appl. No. 11/612,865, filed Dec. 19, 2006, Tsuda, et al.
U.S. Appl. No. 11/736,881, filed Apr. 18, 2007, Hosokawa, et al.

Patent Abstracts of Japan, JP 09-197783, Jul. 31, 1997.
Patent Abstracts of Japan, JP 09-244369, Sep. 19, 1997.
Patent Abstracts of Japan, JP 11-202606, Jul. 30, 1999.
Patent Abstracts of Japan, JP 11-288157, Oct. 19, 1999.
Patent Abstracts of Japan, JP 2000-214669, Aug. 4, 2000.
Patent Abstracts of Japan, JP 2000-310901, Nov. 7, 2000.
Patent Abstracts of Japan, JP 2000-338758, Dec. 8, 2000.
U.S. Appl. No. 11/748,533, filed May 15, 2007, Yoshida, et al.
U.S. Appl. No. 11/836,298, filed Aug. 9, 2007, Tsuda, et al.
U.S. Appl. No. 11/853,490, filed Sep. 11, 2007, Miyamoto, et al.

* cited by examiner

IMAGE FORMING APPARATUS USING A TONER CONTAINER AND A PROCESS CARTRIDGE

BACKGROUND OF THE INVENTION

1. Field of the Invention

The present invention relates to a copier, facsimile apparatus, printer or similar image forming apparatus and more particularly to an image forming apparatus using a process cartridge, which includes a developing device including a toner storing section, and a toner cartridge storing fresh toner for replenishment.

2. Description of the Background Art

It is a common practice with an image forming apparatus to use an image carrier, charger, a developing device and cleaning device implemented as replaceable expendables. For example, the developing device, storing toner therein, is removably mounted to the body of an image forming apparatus and replaced when it runs out of toner. Although this scheme reduces the size of a replaceable unit, it makes not only a mechanism but also work for replacement itself sophisticated.

In light of the above, the image carrier, charger and other expendables and the developing device, storing toner therein, may be constructed into a single process cartridge, in which case the process cartridge will be bodily replaced when the developing device runs out of toner. With the process cartridge, it is possible to effect toner replenishment and the replacement of expendables at the same time for thereby simplifying maintenance. However, when the process cartridge is operated in a condition that consumes much toner, it must be wastefully replaced despite that the number of prints output is small and therefore the expendables are still usable.

Japanese Patent Laid-Open Publication No. 10-239974, for example, discloses a process cartridge configured to replenish toner from a toner bottle, which is removably disposed in the cartridge, to a developing device, thereby obviating the wasteful replacement of the expendables mentioned above. However, the process cartridge taught in the above document has a problem that the toner bottle cannot be replaced unless the entire process cartridge is removed from the body of an image forming apparatus, resulting in troublesome replacement.

To solve the above problem, Japanese Patent Laid-Open Publication No. 11-231631, for example, teaches an image forming apparatus with a process cartridge and a toner bottle removable independently of each other. The toner bottle and process cartridge adjoin each other and are removable from the body of the apparatus independently of each other. However, when the toner bottle and process cartridge are positioned close to each other, the apparatus becomes bulky because optimum design for reducing the size of the apparatus is not attainable. This is particularly true with a color image forming apparatus including four or more toner bottles and four or more process cartridges.

Technologies relating to the present invention are also disclosed in, e.g., Japanese Patent Laid-Open Publication Nos. 9-160364, 2001-27839, 2002-6601, 2002-244359 and 2002-268357.

SUMMARY OF THE INVENTION

It is an object of the present invention to provide an image forming apparatus promoting free design for size reduction.

An image forming apparatus of the present invention includes a process cartridge including a developing device that includes a developer carrier and a toner storing portion storing toner for replenishment. The developer carrier conveys a developer deposited thereon to a developing zone where the developer carrier faces and image carrier. The developing device feeds the toner from the toner storing portion to the developer carrier or the developer deposited on the developer carrier. A toner container stores toner to be replenished to said the storing section. The process cartridge and toner container each are removably mounted to the apparatus independently of each other. A toner conveying device configured to convey the toner from toner container to toner storing portion by using the weight of the toner is mounted on the image forming apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
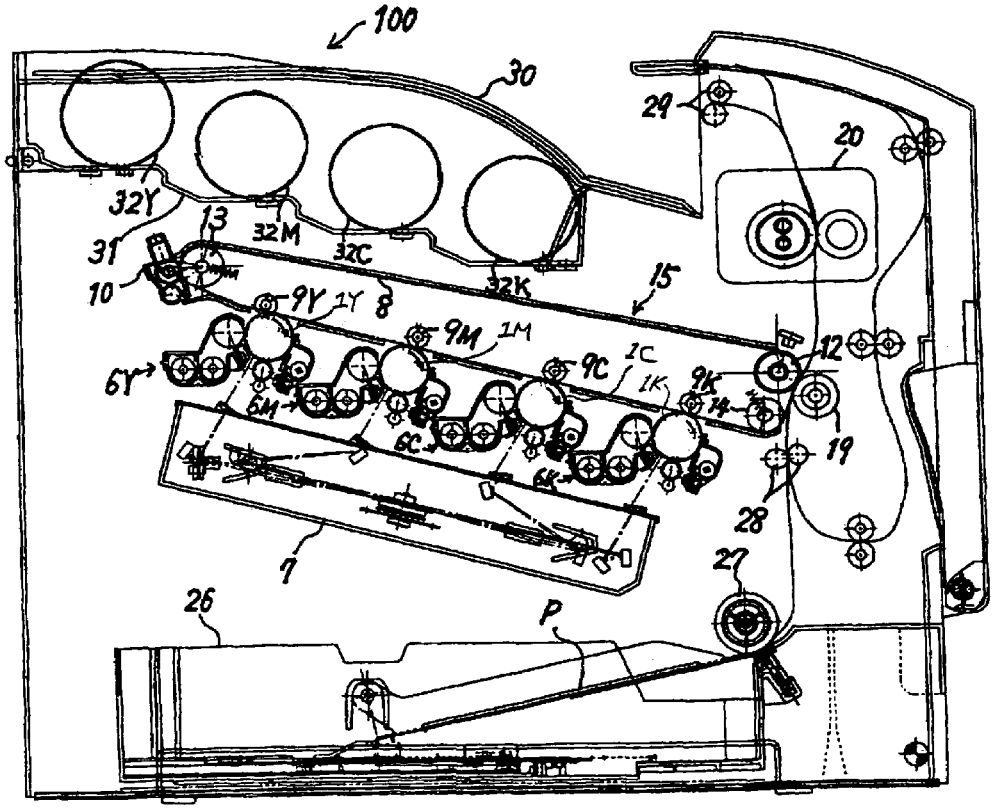
FIG. 1 is a view showing the general construction of an image forming apparatus embodying the present invention.
Figure 2:
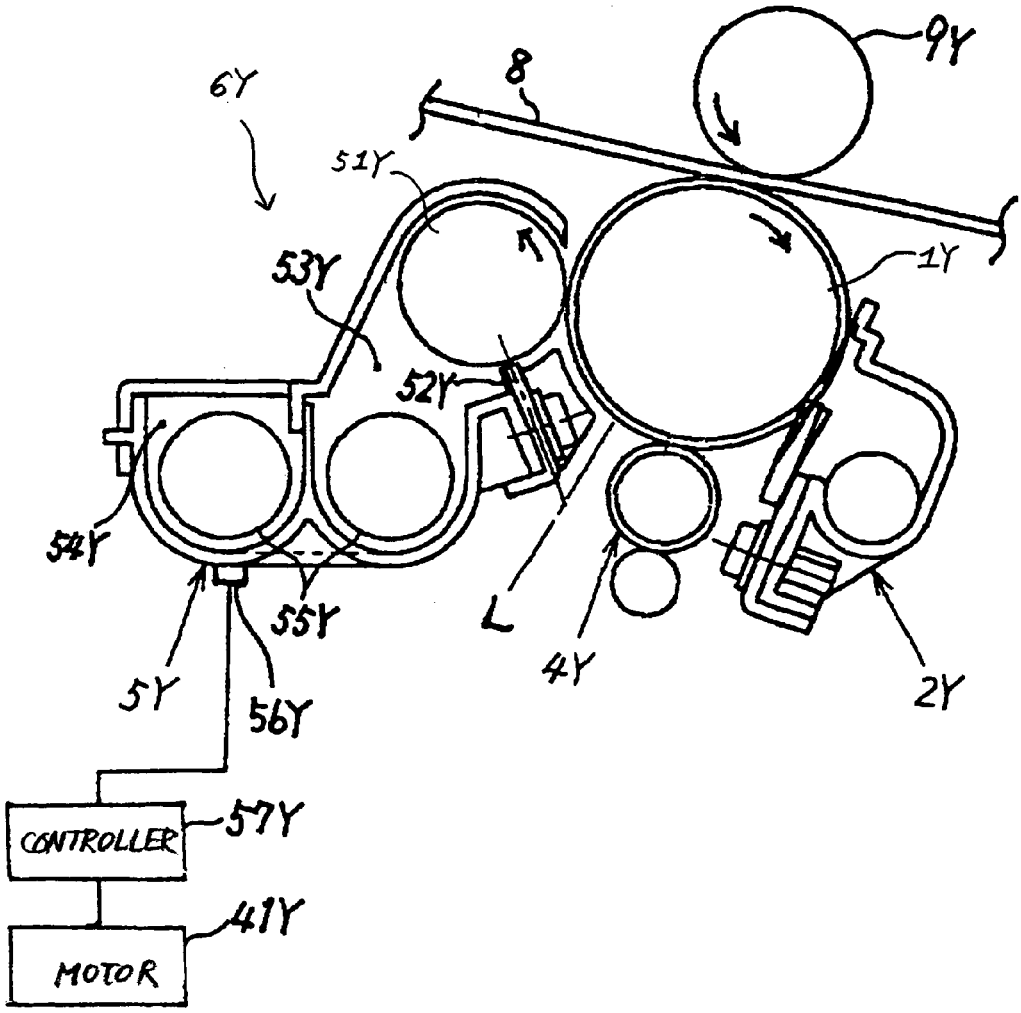
FIG. 2 is an enlarged view showing a process cartridge included in the illustrative embodiment together with members arranged therearound.

Referring to FIG. 1 of the drawings, an image forming apparatus embodying the present invention is shown and implemented as an electrophotographic printer by way of example. As shown, the printer, generally 100, includes four process cartridges 6Y (yellow), 6M (magenta), 6C (cyan) and 6K (black) identical in configuration except for the color of toner to use and each being replaceable when the life ends. FIG. 2 shows the process cartridge 6Y in detail by way of example. As shown, the process cartridge 6Y includes a photoconductive drum or image carrier 1Y, a drum cleaner 2Y, a discharger, not shown, a charger 4Y, and a developing unit 5Y.

The process cartridge 6Y is removably mounted to the printer 100 and allows its expendables to be replaced at a time.

The charger 4Y uniformly charges the surface of the drum 1Y being rotated clockwise, as viewed in FIG. 2, by drive means not shown. A laser beam L scans the thus charged surface of the drum 1Y in accordance with Y image data to thereby form a latent image. Subsequently, the developing device 5Y develops the latent image with Y toner to thereby produce a Y toner image. The Y toner image is then transferred from the drum 1Y to an intermediate image transfer belt (simply belt hereinafter) 8. The drum cleaner 2Y removes the Y toner left on the drum 1Y after such image transfer. Subsequently, the discharger discharges the surface of the drum 1Y to thereby prepare the drum 1Y for the next image formation. An M, a C and a K toner image are respectively formed by the other process cartridges 6M, 6C and 6K in the same manner as the Y toner image and transferred to the belt 8 one above the other, completing a full-color image.

As shown in FIG. 1, an exposing unit 7 is positioned below the process cartridges 6Y through 6K and scans the drums of the process cartridges 6Y through 6K with laser beams L each being modulated in accordance with particular image data, thereby forming latent images on the drums. The exposing unit 7 includes a polygonal mirror driven by a motor to thereby steer the above laser beams L toward the drums via optical lenses and mirrors.

Sheet feeding means is disposed below the exposing unit 7 and includes a sheet cassette 26, a pickup roller 27, and a registration roller pair 28. The pickup roller 27 rests on top one of sheets or recording media P stacked on the sheet cassette 26. The pickup roller 27 is driven counterclockwise, as viewed in FIG. 1, by drive means not shown, paying out the top sheet P toward the registration roller pair 28. The registration roller pair 28 nips the leading edge of the sheet P and then stops rotating. Subsequently, the registration roller pair 28 again starts rotating at adequate timing to thereby convey the sheet P toward a secondary image transfer nip, which will be described later. The pickup roller 27 and registration roller pair or timing roller pair 28 constitute conveying means in combination for conveying the sheet P from the sheet cassette or sheet storing means to the secondary image transfer nip.

An intermediate image transferring unit 15 is located above the process cartridges 6Y through 6K and includes four bias rollers 9Y through 9K for primary image transfer, belt cleaner 10, a backup roller 12 for secondary image transfer, a backup roller 13 for cleaning, a tension roller 14 in addition to the belt 8. The belt 8 is passed over the three rollers 12 through 14 and caused to turn clockwise, as viewed in FIG. 1, by at least one of such rollers. The bias rollers 9Y through 9K, respectively contacting the drums 1Y through 1K via the belt 8, form primary image transfer nips. The bias rollers 9Y through 9K each apply an image transfer bias opposite in polarity to toner, e.g., positive polarity to the inner surface of the loop of the belt 8. The rollers other than the bias rollers 9Y through 9K all are electrically grounded. When the belt 8 sequentially moves via the consecutive primary image transfer nips, the toner images are sequentially transferred from the drums 1Y through 1K to the belt 8 one above the other, completing a full-color or four-color image.

The backup roller 12 contacts the secondary image transfer roller 19 via the belt 8, forming the secondary image transfer nip mentioned earlier. The full-color toner image formed on the belt 8 is conveyed to the sheet P at the secondary image transfer nip. The belt cleaner 10 removes toner left on the belt 8 after the secondary image transfer.

At the secondary image transfer nip, the sheet P is conveyed away from the registration roller pair 28 by the belt 8 and secondary image transfer roller 19 moving in the same direction, as seen at the position where the belt 8 and roller 19 contact each other. Subsequently, a fixing unit 20 fixes the full-color image on the sheet P with heat and pressure. The sheet or print P is then driven out of the printer body to a stack tray 30 formed on the top of the printer body via an outlet roller pair 29.

As shown in FIG. 2, the developing unit 5Y includes a sleeve or developer carrier 51Y accommodating magnetic field forming means thereinside and configured to convey a two-component type developer, i.e., a toner and magnetic carrier mixture deposited thereon. A doctor or metering means 52Y regulates the thickness of the developer being conveyed by the sleeve 51Y. A developer storing portion 53Y is positioned upstream of the doctor 52Y in the direction of developer conveyance and stores the developer removed by the doctor 52Y. A toner storing portion 54Y adjoins the developer storing portion 53Y. Screws 55Y each convey toner while agitating it.

In operation, a developer layer is formed on the sleeve 51Y. Toner is introduced into the developer layer due to the movement of the developer layer being conveyed by the sleeve 51 in an amount that confines the toner content of the developer in a preselected range. The toner thus introduced into the developer layer is charged by friction acting between the toner and the carrier. The developer, containing the charged toner, is magnetically deposited on the sleeve 51Y by the magnetic field forming means disposed in the sleeve 51Y and then conveyed by the sleeve 51Y in the direction indicated by an arrow in FIG. 2 toward a developing zone where the sleeve 51Y faces the drum 1Y. At this instant, the doctor 52Y regulates the thickness of the developer layer, as stated previously. In the developing zone, the toner of the developer layer is transferred from the sleeve 51Y to the latent image formed on the drum 1Y to thereby produce a corresponding toner image. The developer layer left on the sleeve 51Y after the image transfer is again conveyed by the sleeve 51Y to a portion upstream of the developer storing portion 53Y in the direction of developer conveyance.

Referring again to FIG. 1, a bottle storage 31 is positioned between the intermediate image transferring unit 15 and the stack tray 30 and accommodates toner bottles 32Y through 32K respectively storing Y, M, C and K toners. The toner bottles 32Y through 32K each are mounted to the bottle storage 31 from the above. Toner conveying devices, which will be described layer, each replenish one of the Y, M, C and K toners from the associated toner bottle to one of the devices of the process cartridges 6Y through 6K, as needed. It is to be noted that the toner bottles 32Y through 32K each are removable from the printer 100 independently of the process cartridges 6Y through 6K.

Figure 3:
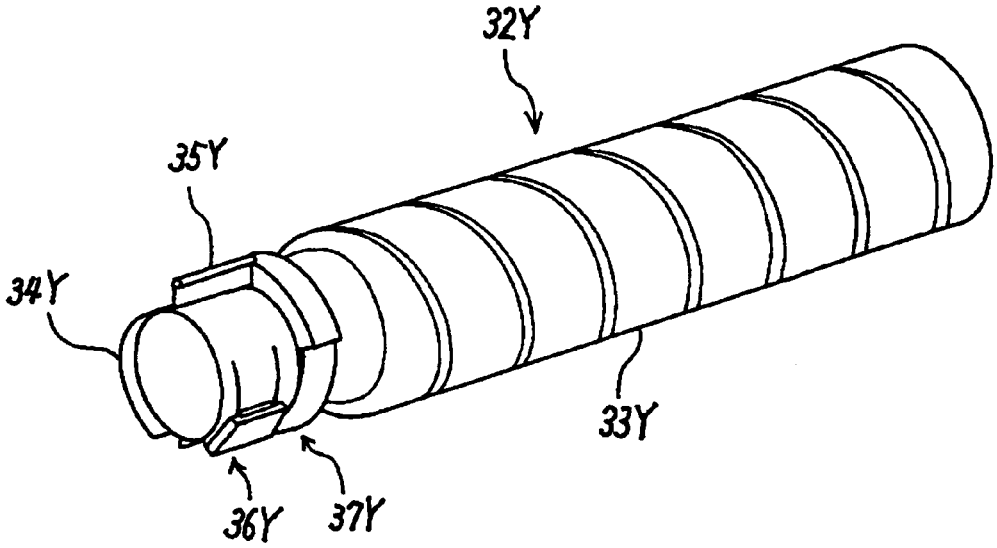
FIG. 3 is an isometric view of a toner bottle applicable to the illustrative embodiment.
Figure 4:
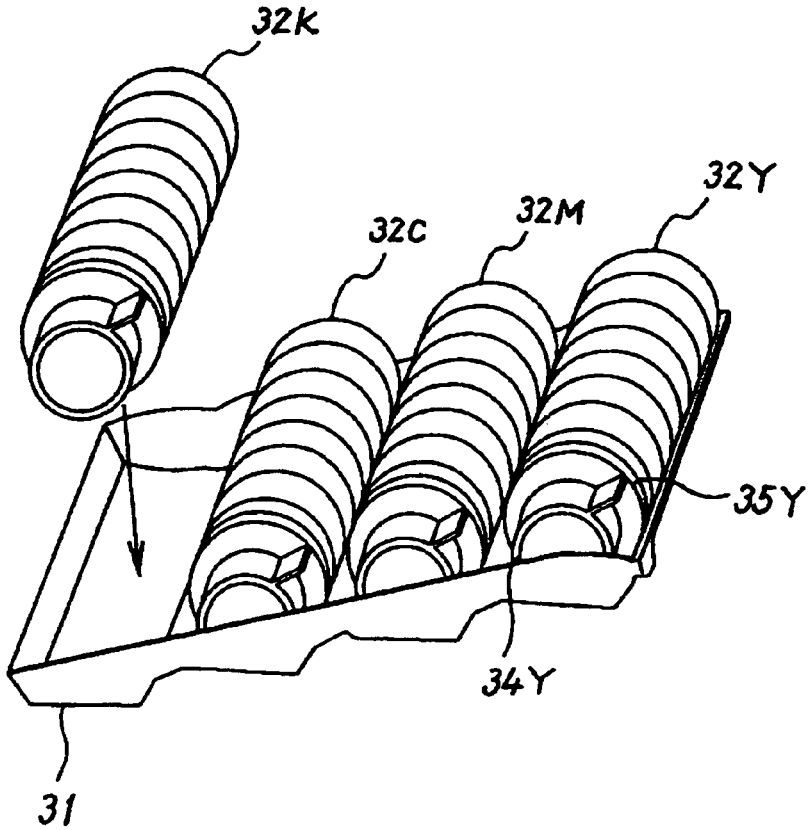
FIG. 4 demonstrates how the toner bottle is mounted to a bottle storage.

FIG. 3 shows the appearance of the toner bottle 32Y by way of example while FIG. 4 shows, e.g., the toner bottle 32K being mounted to the bottle storage 31. As shown in FIG. 3, the toner bottle 32Y is made up of a body 33Y and a resin case 34Y mounted on the end of the body 33Y. A grip 35Y is formed integrally with the resin case 34Y. A gear 37Y is positioned at the end of the body 33 adjacent to the resin case 34Y and rotatable integrally with the body 33.

To mount the toner bottle 32Y to the printer body, a person opens the stack tray 30 upward so as to uncover the bottle storage 31. Subsequently, as shown in FIG. 4, the person lays the toner bottle 32Y in the bottle storage 31 and then turns the grip 35Y. As a result, the resin case 34Y, formed integrally with the resin cases 34Y is also turned and causes a shutter 36Y to move in the circumferential direction of the resin case 34Y, uncovering a toner outlet not shown. At the same time, the resin case 34Y and bottle storage 31 are connected to each other. To dismount the toner bottle 32Y from the printer body, the person turns the grip 35Y in the reverse direction to thereby release the resin case 34Y from the bottle storage 31. At the same time, the shutter 36Y again closes the toner outlet. The person then picks up the toner bottle 36Y by holding the grip 35Y.

As stated above, the toner bottle 32Y, which is mounted to or dismounted via the top of the printer body, is easy to replace. In addition, the grip 35Y allows the resin case 34Y to be easily rotated by hand.

An arrangement is made such that after the toner bottle 32Y has been removed from the printer body, the shutter 36Y does not open even if the grip 35Y of the resin case 34Y is turned by hand. This prevents the shutter 36Y from opening by accident during replacement and causing the toner to drop.

Figure 5:
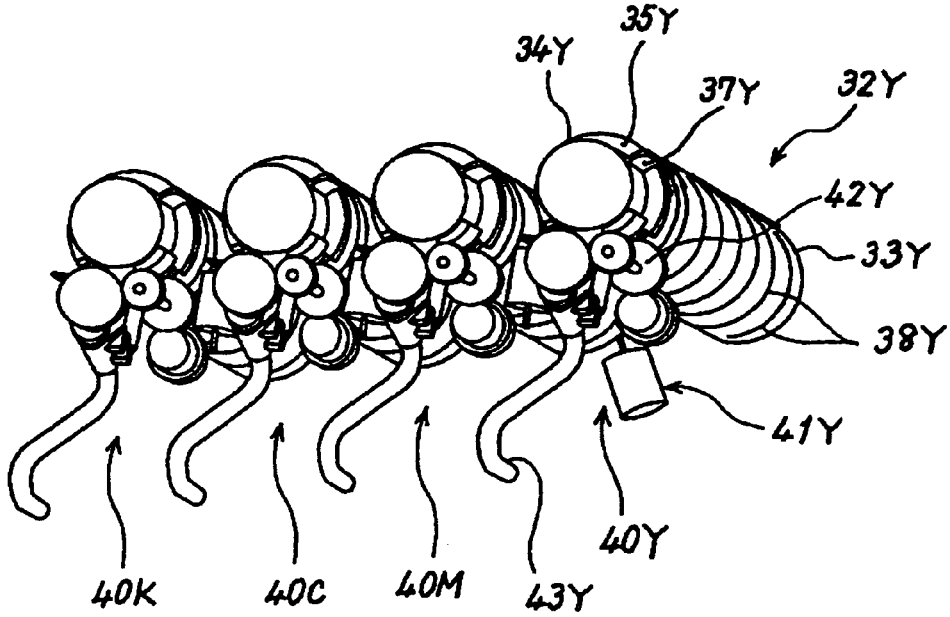
FIG. 5 is an isometric view showing a plurality of toner bottles and a plurality of toner conveying device assigned thereto.
Figure 6:
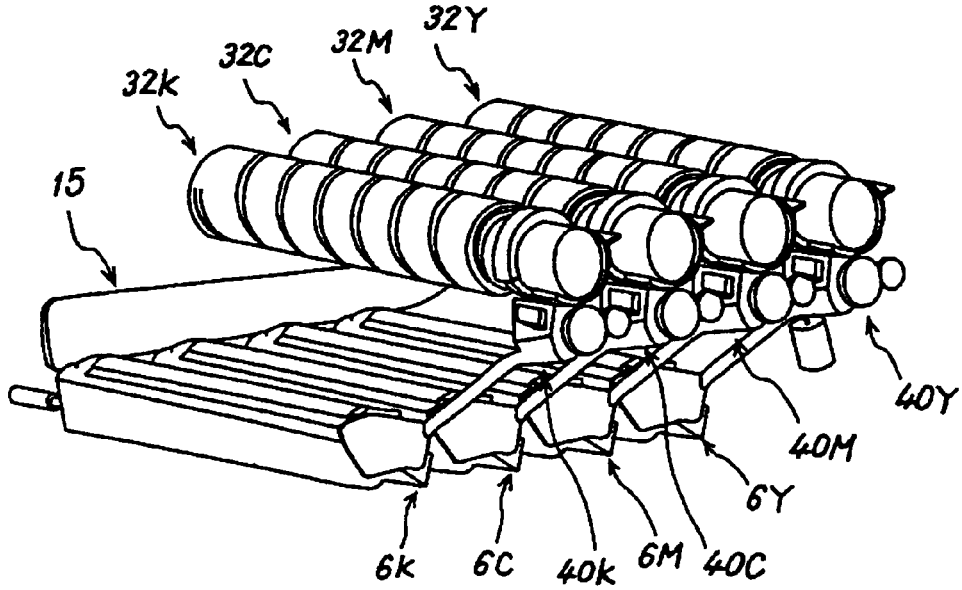
FIG. 6 is an isometric view showing the toner bottles, an intermediate image transferring unit and the toner conveying devices, as seen in a different angle.

Reference will be made to FIG. 5 for describing the toner conveying means mentioned earlier. As shown, toner conveying devices 40Y through 40K are respectively assigned to the toner bottles 32Y through 32K. FIG. 6 shows the toner bottles 32Y through 32K, intermediate image transferring unit 15 and toner conveying devices 40Y through 40K, as seen in a different angle. As shown, the toner conveying devices 40Y through 40K are mounted on the printer body at one side of the intermediate image transferring unit 15. This makes it needless to provide the process cartridges 6Y through 6K or the toner bottles 32Y through 32K with conveying means and therefore reduces the size of each process cartridge or each toner bottle. Further, while process cartridges and toner bottles have heretofore been positioned close to each other and therefore limited in design, the illustrative embodiment allows the process cartridges 6Y through 6K and toner bottles 32Y through 32K to be positioned remote from each other for thereby enhancing free layout and reducing the overall size of the printer 100.

Moreover, the outlets of the toner bottles 32Y through 32K and the replenishing ports of the toner storing portions 54Y through 54K are located at one side of the intermediate image transferring unit 15. This minimizes the length of the toner conveying paths of the toner conveying devices 40Y through 40K for thereby reducing the size of the printer 100 and preventing the toner from stopping up the paths.

Because the toner conveying devices 40Y through 40K are identical in configuration, let the following description concentrate on the toner conveying device 40Y by way of example. As shown in FIG. 5, the toner conveying device 40Y consists mainly of a motor 41Y, a drive gear 42Y, and a pipe 43Y accommodating a coil formed of resin not shown. The drive gear 42Y is held in mesh with the gear 37Y of the toner bottle 32Y, so that the motor 41Y causes the toner bottle 33Y to rotate via the gears 42Y and 37Y. More specifically, when a toner content sensor 56Y shown in FIG. 2 senses the short toner content of the developer stored in the developing device 5Y, a controller 57Y drives the motor 41Y in response to the resulting output of the toner content sensor 56Y.

As shown in FIG. 5, a spiral guide groove 38Y is formed in the body 33Y of the toner bottle 32Y and protrudes into the body 33Y, so that the toner in the body 33Y is conveyed from the deepest end of the body 33Y toward the resin case 34Y when the body 33Y is rotated. The toner brought to the resin case 34Y is caused to drop via an outlet, not shown, formed in the resin case 34Y into a toner inlet, not shown, formed in the toner conveying device 40Y. The toner inlet is communicated to the pipe 43Y. When the motor 41Y is driven, it causes the body 33Y and coil disposed in the pipe 43Y to rotate at the same time. The coil therefore conveys the toner dropped into the toner inlet along the pipe 43, so that the toner is replenished to a toner replenishing port, not shown, formed in the toner storing portion 54Y. In this manner, the toner content of the developer in the developing device 5Y is controlled.

If desired, the toner content sensor 56Y may be replaced with a photosensor, CCD (Charge Coupled Device) camera or similar counting means for counting the number of pixels of a reference image formed on the drum 1Y, in which case control means will control toner replenishment on the basis of the output of the counting means.

It was experimentally found that when the coil in the pipe 43Y was formed of metal, the toner sometimes cohered in masses when the outer periphery of the coil and the inner periphery of the pipe 43Y rubbed each other, resulting in the local omission of an image or similar image defect. In light of this, in the illustrative embodiment, the coil is formed of resin.

Figure 7:
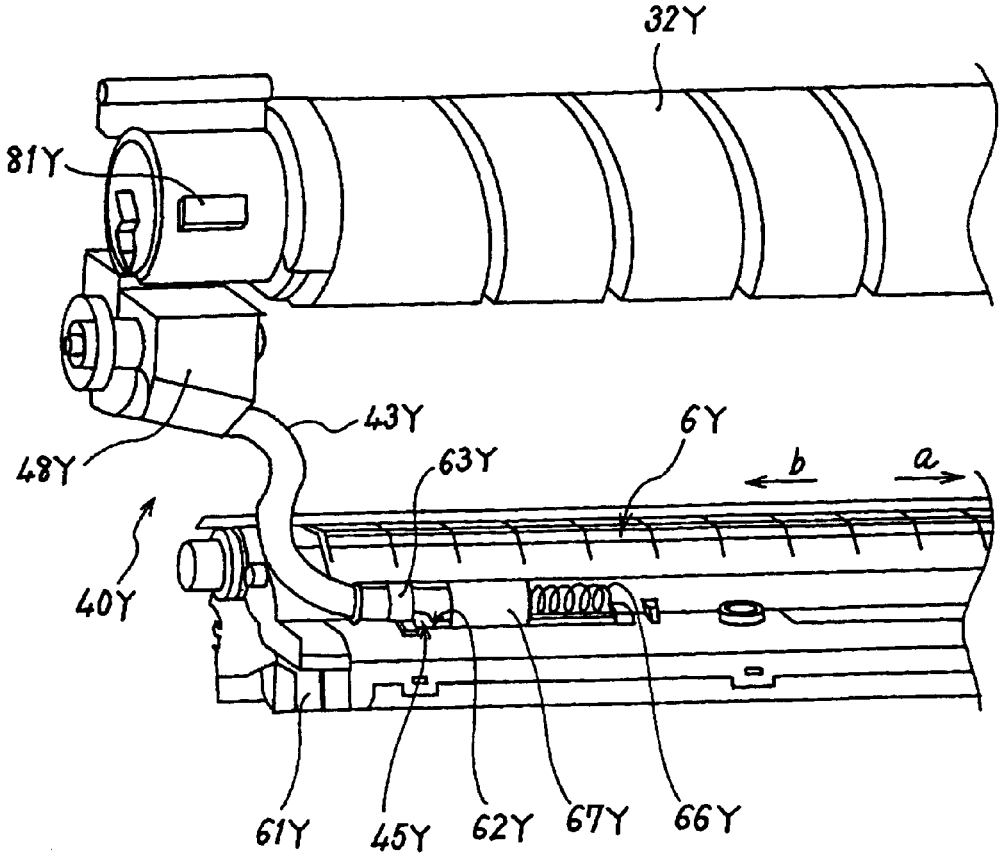
FIG. 7 is an isometric view showing an arrangement for connecting a pipe and the process cartridge.
Figure 8:
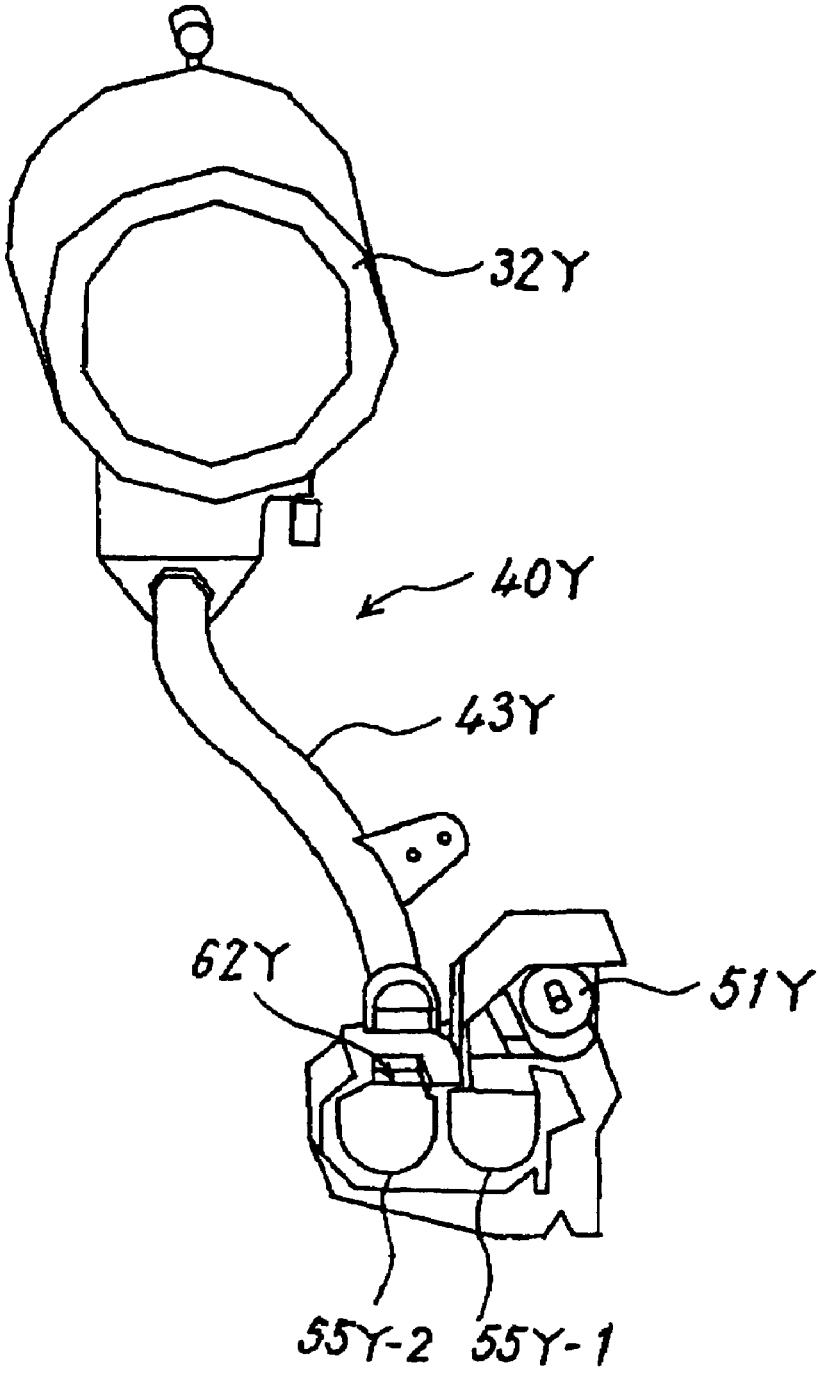
FIG. 8 is an isometric view showing the pipe, as seen in a different angle.
Figure 10:
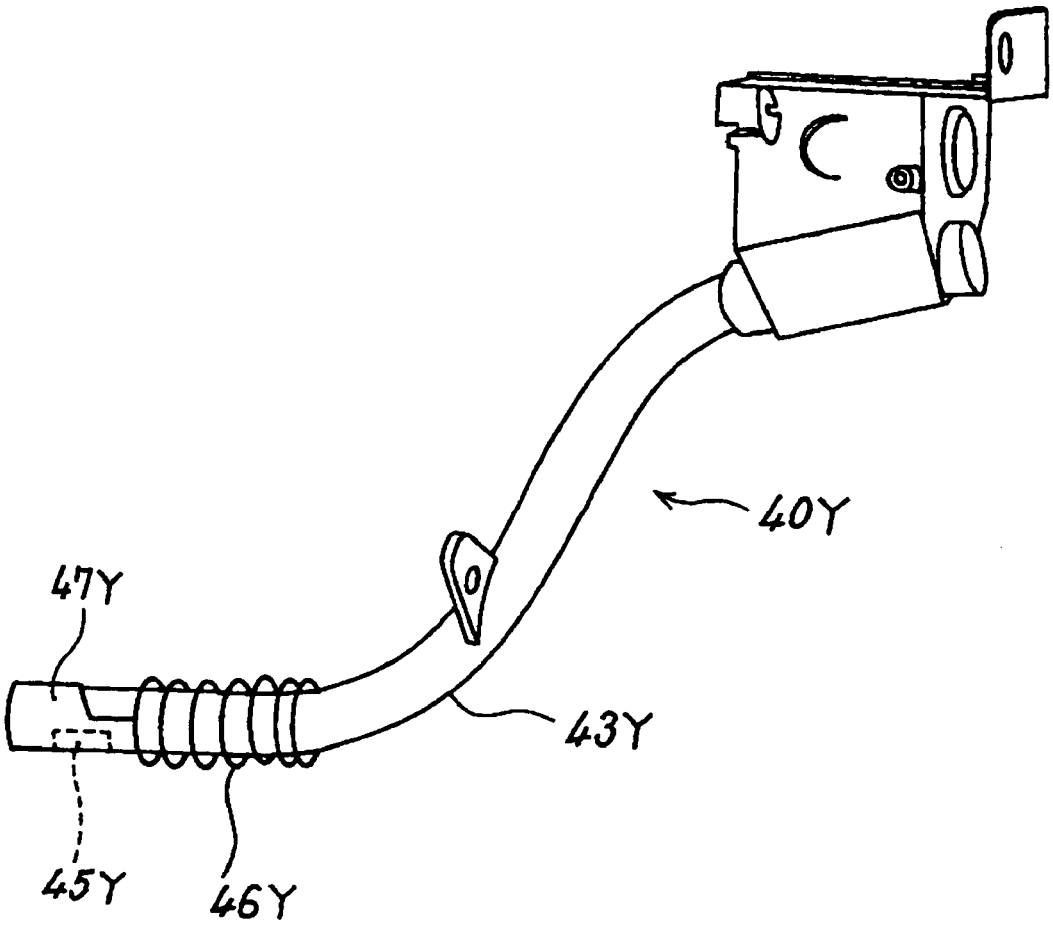
FIGS. 10 and 11 are views showing one of the toner conveying devices assigned to yellow toner.
Figure 11:
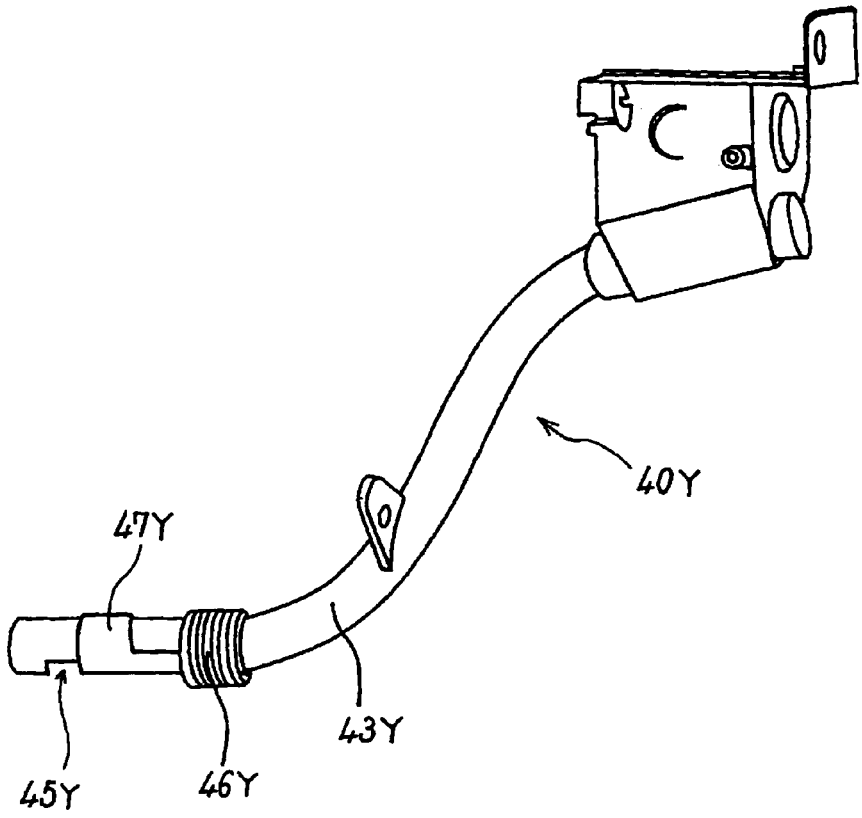
Figure 12:
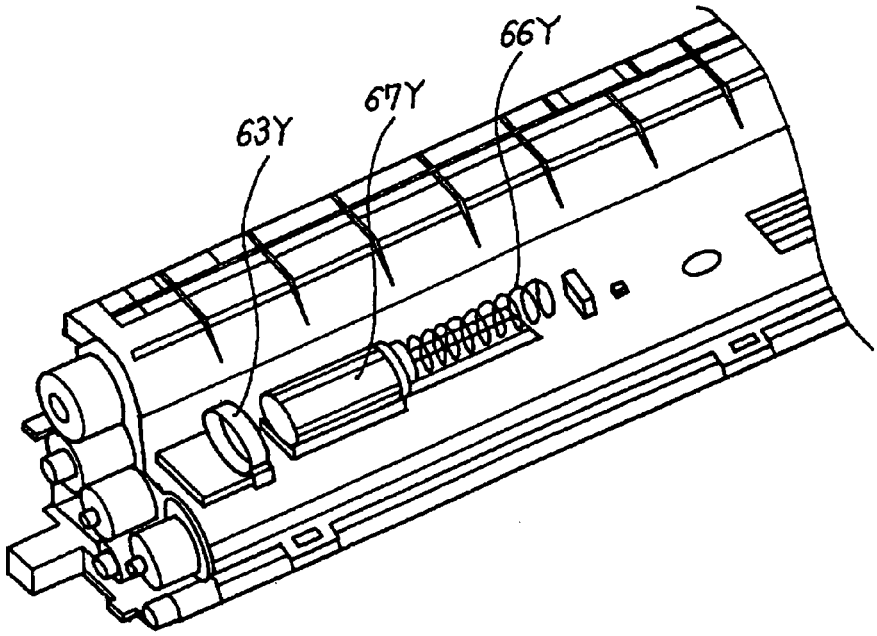
FIGS. 12 and 13 are views showing the process cartridge using yellow toner.
Figure 13:
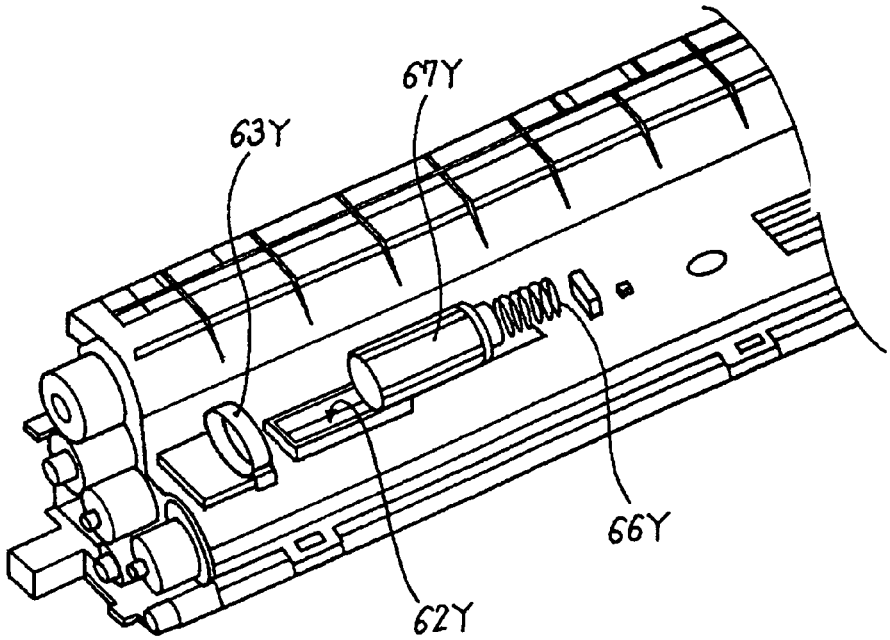

Hereinafter will be described specific configurations applicable to the illustrative embodiment. FIG. 7 shows a specific configuration for establishing communication between a toner replenishing port 62Y included in the process cartridge 6Y and the pipe 43Y. FIG. 8 shows the configuration, as seen in a different angle. FIGS. 10 and 11 show a specific configuration of the toner conveying device 40Y. Further, FIGS. 12 and 13 show a specific arrangement around the toner replenishing port 62Y of the process cartridge 6Y.

The process cartridge 6Y shown in FIG. 7 is positioned at the rear side when mounted to the printer body. A pair of end plates 61Y (only one is shown) are mounted on the axially opposite ends of the process cartridge 6Y and cooperate to support the sleeve 51Y, screws 55Y-1 and 55Y-2 and so forth. The end plates 61Y face each other at a preselected distance from each other. The toner replenishing port 62Y is formed in the upper portion of the developer storing portion 53Y within the above distance. This makes it needless to extend the distance between the end plates 61Y more than necessary for locating the toner replenishing port 62Y. In addition, it is not necessary to locate a toner replenishing region outside of the end plate 61Y, so that the process cartridge 6Y is prevented from becoming bulky.

The specific configuration shown in FIG. 7 is similarly practicable even when the distance between the end plates 61Y, which support the end portions of the various components of the process cartridge 6Y is locally different. The crux is that the toner replenishing port 62Y be positioned within the preselected distance between the end plates 61Y.

The toner replenishing port 62Y is positioned at a lower level or height than the top of the sleeve 51Y. The end of the pipe 43Y is positioned above the toner replenishing port 62Y while an opening 45Y, which faces the toner replenishing port 62Y, is formed in the bottom of the pipe 43Y. The end of the pipe 43Y constitutes a tubular engaging portion to be engaged with the process cartridge 6Y. More specifically, the end of the pipe 43Y is slidable in parallel to the direction in which the process cartridge 6Y is mounted to or dismounted from the printer body. After the process cartridge 6Y has been inserted into the printer body in a direction indicated by an arrow b in FIG. 7, the process cartridge 6Y is stopped when the toner replenishing portion 62Y faces the opening 45Y of the pipe 43Y.

As shown in FIG. 7, a support ring or ring-like support 63Y may be mounted on the upper portion of the process cartridge 6Y and sized to receive the end of the pipe 43Y. In this case, when the pipe is connected to the process cartridge 6Y, the end of the pipe 43Y is received in the support ring 63Y. When the process cartridge 6Y is dismounted from the printer body in a direction indicated by an arrow a, the pipe 43Y is released from the support ring 63Y.

Further, a shutter 47Y is disposed in the opening 45Y of the pipe 43Y while a shutter 67Y is disposed in the toner replenishing port 62Y of the process cartridge 6Y. The shutters 47Y and 67Y each are configured to open or close when the process cartridge 6Y is mounted to or dismounted from the printer body, respectively.

Figure 9:
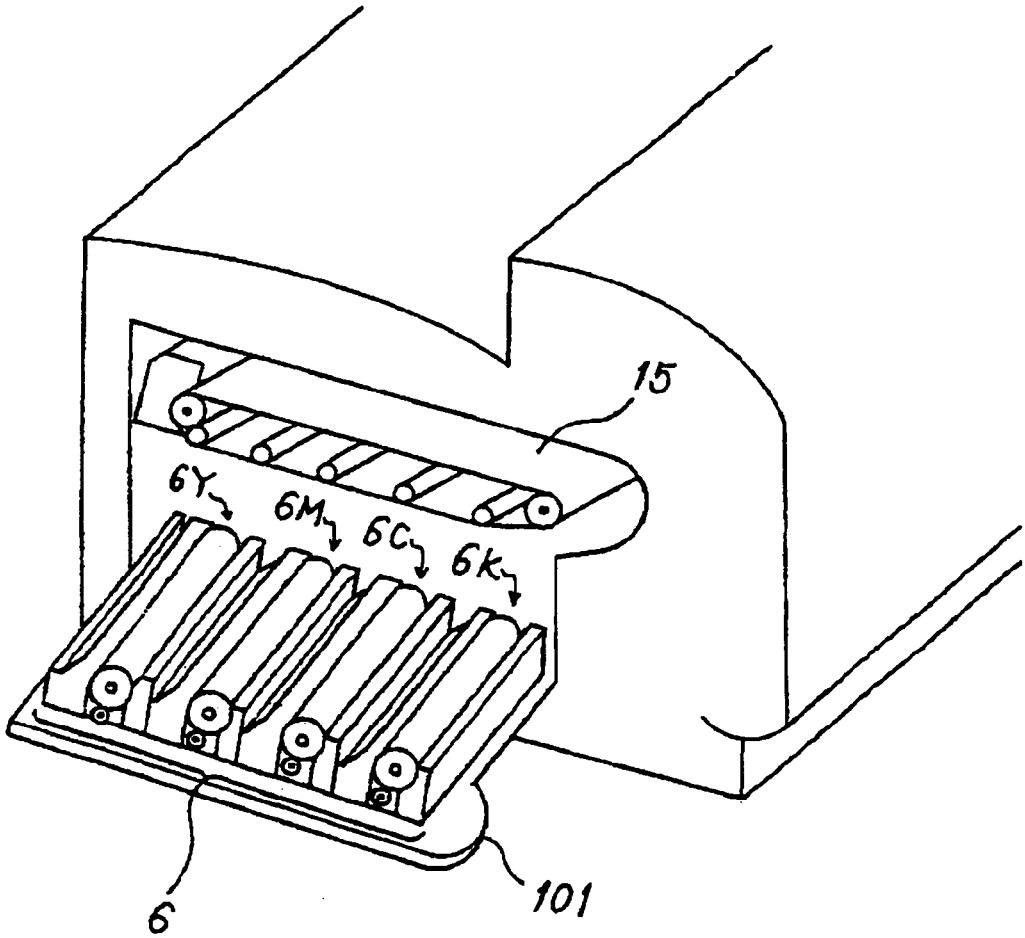
FIG. 9 shows how the process cartridge is pulled out.

First, how the process cartridge 6Y is mounted to or dismounted from the printer will be described. To pull out the process cartridge 6Y from the position shown in FIG. 1, a person opens a front cover 101 mounted on the front of the printer body and then pulls the process cartridge 6 forward. A guide member, not shown, is mounted on the printer body for allowing the process cartridge 6Y to slide into or out of the printer body. When the person starts pulling out the process cartridge 6, the guide members guide the end of the drum to a retracted position. As the person further pulls out the process cartridge 6, the end of the drum is released from the guide member. As a result, as shown in FIG. 9, the process cartridge 6 is removed via an opening formed in the front of the printer body. To mount the process cartridge 6, the person inserts the process cartridge 6 into the printer body until the process cartridge 6 has been stopped, and then closes the front cover 101.

A specific configuration for causing the shutters 47Y and 67Y to open and close will be described hereinafter. FIGS. 10 and 12 respectively show the toner conveying device 43Y and process cartridge 6Y in a condition wherein the process cartridge 6Y is not mounted to the printer body. As shown, the shutter 47Y of the pipe 43Y, constantly biased by a spring 46Y, closes the opening 45Y while the shutter 67Y of the process cartridge 6Y, constantly biased by a spring 66Y, closes the toner replenishing port 62Y.

When the process cartridge 6Y is slid into the printer body, the support ring 63Y is coupled over the pipe 43Y. At this instant, because the shutter 47Y cannot be passed through the support ring 63Y and is therefore stopped by the support ring 63Y, compressing the spring 66Y. As a result, as shown in FIG. 11, the shutter 47Y is slid to uncover the opening 45Y. At the same time, as the process cartridge 47 is further slid into the printer body, the end of the pipe 43Y passed through the support ring 63Y presses the shutter 67Y of the process cartridge 6Y, compressing the spring 66. Consequently, the shutter 67Y is slid to uncover the toner replenishing port 62Y. Finally, the process cartridge 6Y is stopped at the preselected position shown in FIG. 7, so that the opening 45Y and toner replenishing port 62Y are brought into communication with each other. A seal member is located at a position where the two openings 45Y and 62Y face each other in order to prevent toner from leaking.

On the other hand, when a person pulls out the process cartridge 6Y from the printer body in the condition shown in FIG. 7, the spring 66Y, compressed by the pipe 43Y, springs back and forces the shutter 67Y toward the rear of the printer body. As a result, the shutter 67*a* is moved in the direction a to again cover the toner replenishing port 62Y, so that the condition shown in FIG. 12 is restored. At the same time, the pipe 43Y is released from the support ring 63Y of the process cartridge 6Y with the result that the spring 46Y, compressed by the support ring 63Y, springs back while forcing the shutter 47Y toward the end of the pipe 43Y. Consequently, the shutter 47Y, moving in the direction b, again closes the opening 45Y, so that the condition shown in FIG. 10 is restored.

Figure 14:
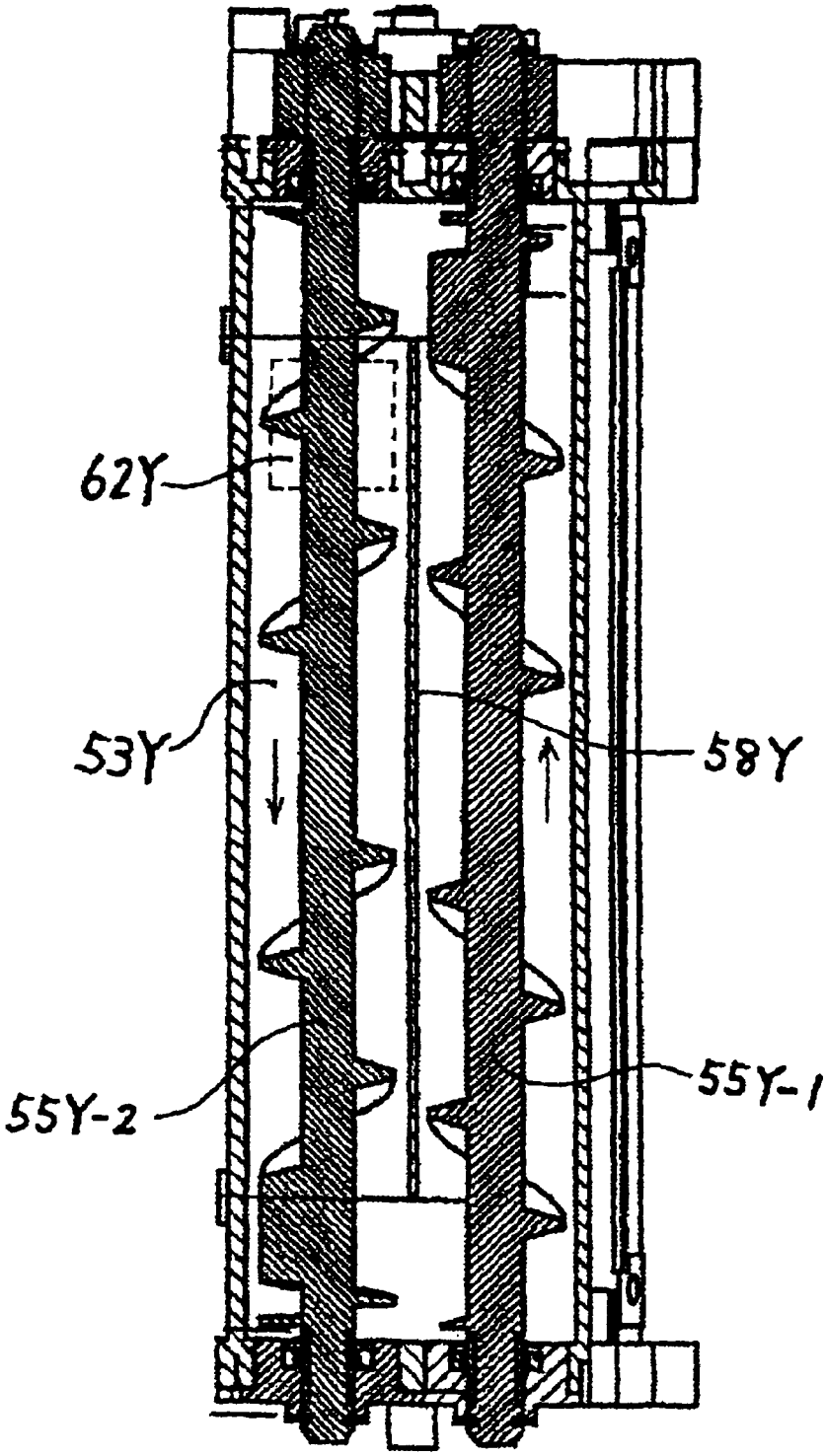
FIG. 14 is a perspective plan view of the process cartridge.

FIG. 14 shows a specific configuration of the process cartridge 6Y of FIG. 7 in a perspective view, as seen from the above. As shown, the toner replenishing opening 62Y is positioned above the screw 55Y-2 adjoining the other screw 55Y-1, which is close to the sleeve 51Y, so that toner is replenished to the top of the screw 55Y-2 remote from the sleeve 51Y. In this configuration, the toner replenished is agitated by the screw 55Y-2, conveyed to the agitating region of the screw 55Y-1, and then fed to the sleeve 51Y. This successfully prevents toner not sufficiently agitated from depositing on the sleeve 51Y.

As shown in FIG. 14, a partition 58Y isolates the conveyance paths of the two screws 55Y-1 and 55Y-2 except for opposite end portions in the axial direction. The toner replenishing port 62Y is located above the portion where the above paths are isolated from each other by the partition 58Y. In this configuration, toner replenished from above the portion mentioned above is surely agitated by the screw 55Y-2 and then conveyed to the screw 55Y-1 to be thereby sufficiently charged. Otherwise, it is likely that the toner replenished moves to the screw 55Y-1 close to the sleeve 51Y without being sufficiently agitated by the screw 55Y-2.

Figure 15:
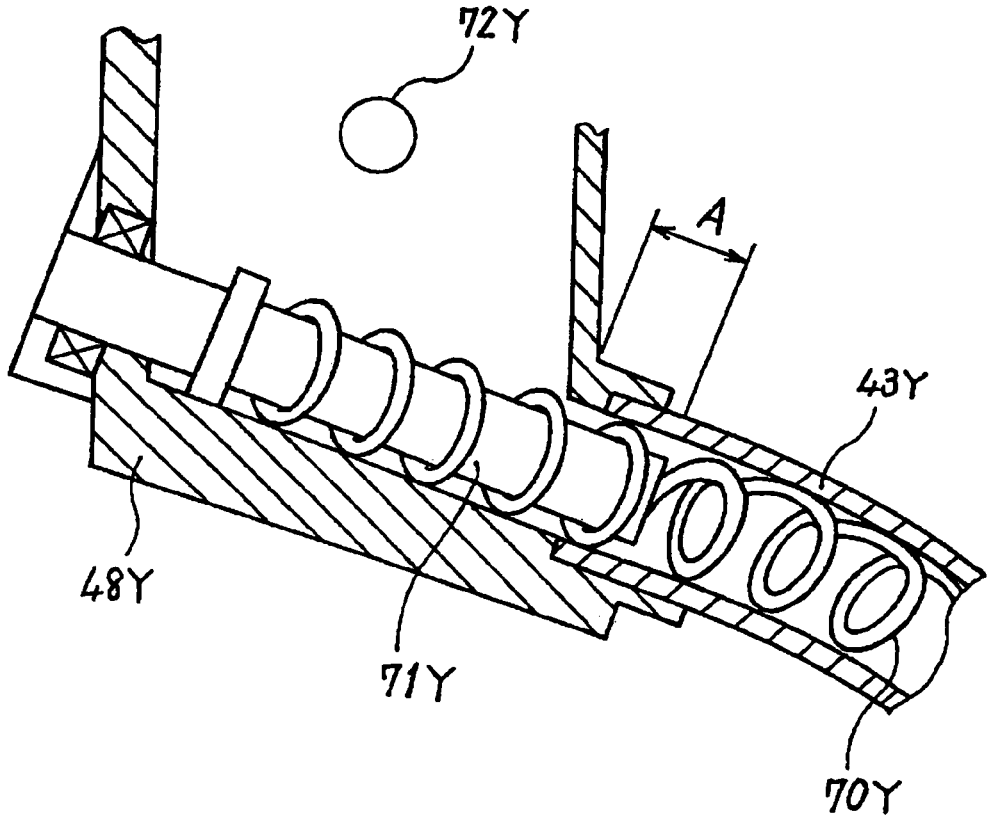
FIG. 15 is a view showing a subhopper to which toner discharged from the toner bottle enters.

FIG. 15 is a perspective side elevation showing a specific configuration of a subhopper 48Y shown in FIG. 7. As shown, a coil 70Y is disposed in the pipe 43Y. The gap between the inner periphery of the pipe 43Y and the outer periphery of the coil 70Y is selected to fall between about 0.1 mm and about 0.2 mm. The coil 70Y, exerting a conveying force on toner, prevents the toner from accumulating in the pipe 43Y and therefore prevents the toner from flowing into the developing device 5Y in a mass due to some impact.

Further, a minimum of stress occurs in the coil 70Y against bending, so that the coil 70Y can rotate even when the pipe 43Y is bent. Stated another way, the pipe 43Y does not have to be straight and can therefore be freely laid out to thereby make the entire printer small size.

In the subhopper 48Y, a rotary shaft 71Y is adhered to the inner periphery of the coil 70Y. In a range A between the downstream end of the subhopper 48Y in the direction of conveyance to the downstream end of the rotary shaft 70Y, the coil 70Y is provided with a pitch of one or more turns. In the range A, the coil 70Y contacts the inner periphery of the pipe 43Y while the shaft 71Y adjoins the inside diameter of the coil 70Y. Further, because the coil 70Y has a pitch of one or more turns, hardly any space that allows toner to pass through the range A due to its own weight is available. It is therefore possible to block toner in the range while allowing it to be conveyed only by the rotation of the coil 70Y. This stabilizes the amount of toner to pass through the range A and therefore stabilizes the amount of toner to be replenished to the developing device 5Y positioned downstream of the range A.

An alternative embodiment of the present invention will be described hereinafter. Because the alternative embodiment is identical in configuration with the previous embodiment described with reference to FIGS. 1 through 6, let the following description concentrate on differences between the former and the latter. Briefly, in the illustrative embodiment, a toner replenish mode, which is effected after the mounting of the toner bottle 32Y for preparing the developing device 5Y and toner conveying device 40Y for development, is implemented by the periodic, intermittent start and stop of toner conveyance.

More specifically, when the toner bottle 32Y is replaced, no toner exists in the developing device 5Y and toner conveying device 40Y. Thereafter, after the replacement of the toner bottle 32Y, it is necessary to replenish toner to the developing device 5Y and toner conveying device 40, so that development can be immediately effected at the time of the next image formation.

It has been customary to continuously replenish, after the replacement of the toner bottle 32Y, fresh toner up to a desired amount in a toner replenish mode. In the image forming apparatus shown in FIGS. 1 through 6, the toner bottle 32Y and process cartridge 6Y are remote from each other while the toner bottle 32Y is positioned above the process cartridge. If toner is replenished to the toner conveying device 40Y in this type of image forming apparatus, then toner in the toner conveying device 40Y drops due to its own weight because of the inclination of the pipe 43Y, i.e., even toner that should be replenished to the toner conveying device 40Y flows into the developing device 5Y over the agitating ability of the device 5Y. As a result, background contamination, for example, occurs due to short agitation after the replacement of the toner bottle 32Y.

To solve the above problem, the speed at which the toner bottle 32Y and coil 70Y are driven in the event of toner conveyance may be lowered in order to prevent toner from flowing into the developing device 5Y over the agitating ability of the device 5Y. This scheme, however, extends a period of time necessary for toner to be replenished to the toner conveying device 40Y in a desired amount.

Experiments were conducted to determine why toner, expected to be replenished to the toner conveying device 40Y, flowed as far as the developing device 5Y. The experiments showed that much air was introduced into toner dropping from a toner bottle and increased the fluidity of the toner to such a degree that the toner stayed in the toner conveying device 40Y little, resulting in the problem stated above.

Figure 16:
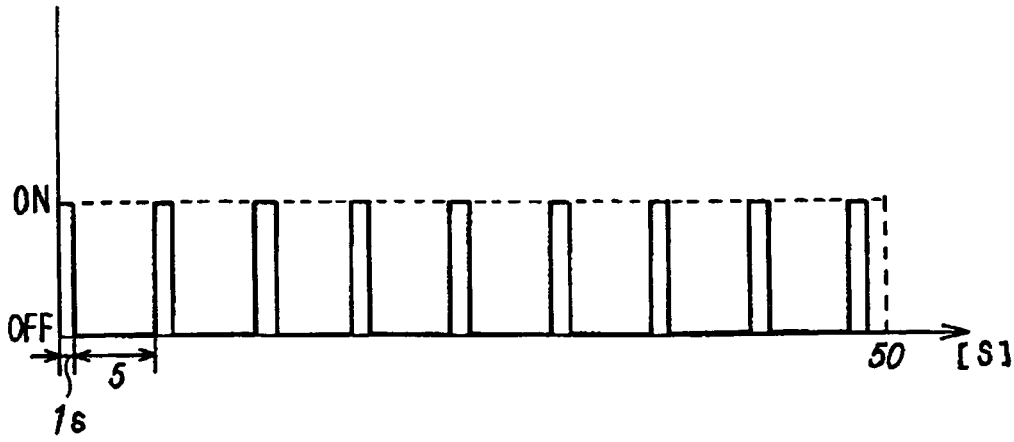
FIG. 16 is a timing chart demonstrating a specific intermittent operation to be effected in a toner replenish mode.

In light of the above, the illustrative embodiment does not continuously operate the toner bottle and toner conveying device 40Y, but periodically start and stop the conveyance of toner for replenishment, as shown in FIG. 16 specifically. As shown, in the specific time table, a step of effecting toner conveyance for 1 second and then interrupting it for 5 seconds is repeated. Toner, dropped from the toner bottle into the toner conveying device 40Y for 1 second, is mixed with air and increased in fluidity. Subsequently, when the conveyance is interrupted for 5 seconds, only gravity acts on the toner and causes the toner to release air due to its own weight. As a result, the toner is lowered in fluidity and does not easily flow down the pipe 43Y, but fills the toner conveying device 40Y, thereby solving the problem stated above.

If desired, the coil 70Y and shaft 71Y, FIG. 15, may be used to more surely prevent toner expected to flow into the toner conveying device 40Y from flowing as far as the developing device 5Y.

As shown in FIG. 15, to determine the time for ending the toner replenish mode, a toner sensor 72Y is disposed in the subhopper 48Y to which toner from the toner bottle 32Y enters. When the output of the toner sensor 72Y shows that a preselected amount of toner is left in the subhopper 48Y in the toner replenish mode, the toner replenish mode is ended. More specifically, a step of effecting conveyance for 1 second and then interrupting it for 4 seconds is repeated until the output of the toner sensor 72Y produces the above output. The toner sensor 72Y may additionally play the role of means for sensing a condition wherein the toner bottle body 33Y has run out of toner, but toner still exists in the toner conveying device 40Y and developing device 5Y (near empty condition).

The time for ending the toner replenish mode may be determined on the basis of the duration of toner replenish mode effected. For example, as shown in FIG. 16, when the intermittent 1 second of conveyance and 5 seconds of interruption is repeated for 50 seconds, the toner replenish mode is ended by determining that replenishment has completed.

If desired, the sensor scheme and duration scheme stated above may be used in combination. More specifically, the toner replenish mode may be ended on the basis of one of the output of the toner sensor 72Y and the elapse of the preselected period of time occurred earlier than the other. This successfully reduces the duration of the toner replenish mode.

The ON/OFF ratio of the intermittent operation described above is determined in accordance with the amount of toner initially packed in the toner bottle 33Y mounted to the printer body. More specifically, when the amount of toner in the toner bottle body 33Y is relatively small, the toner is mixed with air within the body 33Y as well and therefore replenished to the subhopper 48Y with high fluidity. In this case, therefore, the duration of conveyance (ON) and that of interruption (OFF) are shortened and extended, respectively, thereby lowering the fluidity of the above toner and preventing the toner from flowing into the developing device 5Y. On the other hand, toner, packed in the body 33Y in a large amount, contains little air and can be replenished to the subhopper 48Y with relatively low fluidity. In this case, the duration of conveyance (ON) and that of interruption (OFF) are extended and shortened, respectively, thereby reducing the replenishing time.

Figure 17:
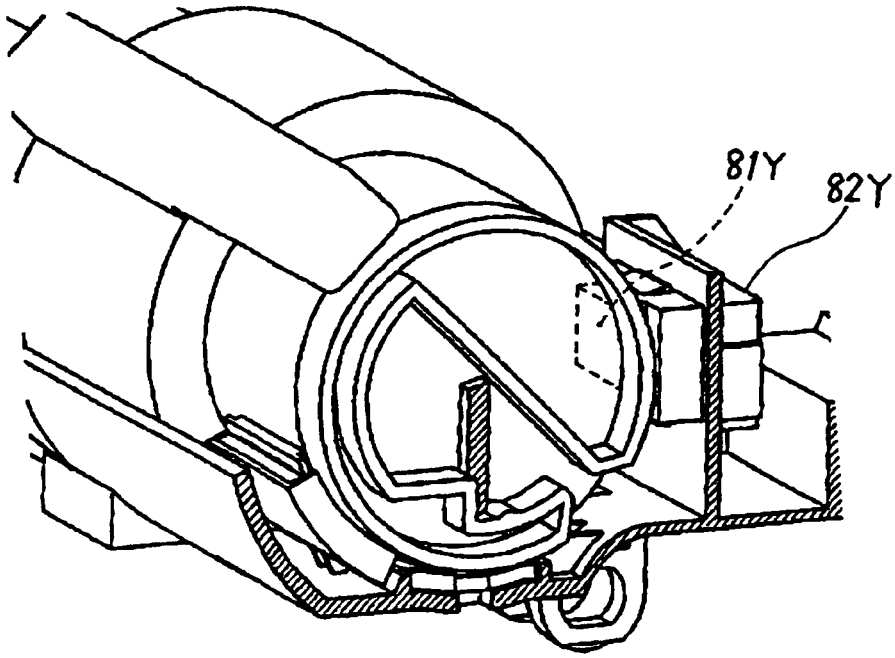
FIG. 17 showing how the toner bottle and bottle storage are engaged with each other.

FIG. 17 shows a specific means for determining the amount of toner initially present in the toner bottle 33Y mounted to the printer body. As shown, an ID (identification) chip 81Y is mounted on the resin case 34Y of the toner bottle 32Y and stores data representative of the amount of toner packed in the toner bottle body 33Y beforehand. When the toner bottle 32Y is mounted to the printer body, a relay connector 82Y mounted on the printer body reads the data of the ID chip 81Y. The ON duration and OFF duration stated are determined in accordance with the data so read out of the ID chip 81Y.

If desired, the IC chip 81Y may additionally store other useful data, e.g., the date of production of the toner bottle 32Y and the date of mounting of the toner bottle 32Y to the printer body.

The ON/OFF controlled toner replenish mode described above may be replaced with a toner replenish mode in which a conveying operation and an operation for exerting a force opposite in direction to conveyance (negative conveying operation hereinafter) are alternately effected. More specifically, after 1 second of conveying operation, 4 seconds of negative conveying operation may be effected to exert a force opposite in direction to conveyance on the toner, which tends to flow through the pipe 43Y. This is also successful to reduce the amount of toner to flow into the developing device 5Y.

In summary, it will be seen that the present invention further promotes the size reduction of, e.g., process cartridges as well as easier replacement thereof and reduces cost. Particularly, the present invention obviates background contamination and other image defects after the replacement of a toner bottle.

Various modifications will become possible for those skilled in the art after receiving the teachings of the present disclosure without departing from the scope thereof.

What is claimed is:

1. An image forming apparatus, comprising:

a process cartridge including a developing device, the developing device including:

a developer carrier configured to convey a developer deposited thereon to a developing zone where said developer carrier faces an image carriers, and a toner storing portion configured to store toner, said developing device configured to feed said toner from said toner storing portion to said developer carrier;

a toner container storing fresh toner to be replenished to said toner storing portion, said toner container including a toner storing body and a cap rotatably affixed to the toner storing body, the cap including an opening;

a toner container holder configured to hold the toner container, the toner container holder fixedly holding the cap while allowing the container body to rotate in order to dispense the fresh toner from the container body through the opening of the cap; and a toner conveying device configured to convey the fresh toner received from the opening of the cap of said toner container to said toner storing portion, wherein said process cartridge and said toner container each are removably mounted to said image forming apparatus independently of each other.

2. The apparatus as claimed in claim 1, wherein said process cartridge is positioned at a lower level than the opening of the cap.

3. The apparatus as claimed in claim 1, wherein said toner container holder is configured such that said toner container is mounted to or dismounted from a body of said image forming apparatus from above said body.

4. The apparatus as claimed in claim 1, further comprising:

a shutter mechanism attached to said cap and movable in a circumferential direction of said cap, and when said cap is turned to a preselected angle, said cap is locked to said toner container holder while said shutter mechanism opens said opening of the cap in an interlocked relation to a movement of said cap.

5. The apparatus as claimed in claim 4, wherein:

said shutter mechanism closes said opening of the cap when said cap is turned in a direction opposite to a locking direction to thereby unlock said cap from said toner container holder.

6. The apparatus as claimed in claim 4, wherein:

when said cap is turned relative to said toner storing body after removal of said toner container from said body of said apparatus, said shutter mechanism does not open said opening of said cap.

7. The apparatus as claimed in claim 1, wherein:

said toner storing body of the toner container is configured to convey the fresh toner stored therein in a preselected direction when rotated relative to said cap, and said toner conveying device operates in synchronism with a rotation of said toner storing body.

8. The apparatus as claimed in claim 7, further comprising:

a shutter mechanism attached to said cap and movable in a circumferential direction of said cap, and when said cap is turned to a preselected angle, said cap is locked to said toner container holder while said shutter mechanism opens said opening of the cap in an interlocked relation to a movement of said cap.

9. The apparatus as claimed in claim 8, wherein:

said shutter mechanism closes said opening of the cap when said cap is turned in a direction opposite to a locking direction to thereby unlock said cap from said toner container holder.

10. The apparatus as claimed in claim 8, wherein:

when said cap is turned relative to said toner storing body after removal of said toner container from said body of said apparatus, said shutter mechanism does not open said opening of said cap.

11. The apparatus as claimed in claim 1, wherein said toner conveying device comprises:

a pipe forming a toner conveying path and a coil disposed in said pipe and movable to exert a conveying force on the toner toward a downstream side in a direction of toner conveyance.

12. The apparatus as claimed in claim 11, further comprising:

a shutter mechanism attached to said cap and movable in a circumferential direction of said cap, and when said cap is turned to a preselected angle, said cap is locked to said toner container holder while said shutter mechanism opens said opening of the cap in an interlocked relation to a movement of said cap.

13. The apparatus as claimed in claim 12, wherein:

said shutter mechanism closes said opening of the cap when said cap is turned in a direction opposite to a locking direction to thereby unlock said cap from said toner container holder.

14. The apparatus as claimed in claim 12, wherein:

when said cap is turned relative to said toner storing body after removal of said toner container from said body of said apparatus, said shutter mechanism does not open said opening of said cap.

15. The apparatus as claimed in claim 1, further comprising:

toner content sensing means for sensing a toner content of the developer present in said developing device, and control means for controlling replenishment of the toner to said developing device in accordance with an output of said toner content sensing means.

16. The apparatus as claimed in claim 1, further comprising:

counting means for counting a number of pixels of an image formed, and control means for controlling replenishment of the toner to said developing device in accordance with an output of said counting means.

17. The apparatus as claimed in claim 1, wherein:

said process cartridge and said toner container respectively comprise at least two process cartridges and at least two toner containers, an intermediate image transferring unit is positioned between at least two process cartridges and said at least two toner containers, and outlets of said at least two toner cartridges, said toner conveying means and outlets of toner storing bodies are positioned at one side of said intermediate image transferring unit.

18. The apparatus as claimed in claim 1, wherein:

after mounting of said toner container to a body of said apparatus, a toner replenish mode for replenishing the toner to a toner conveying path is effected before development to thereby prepare said toner conveying path for development, and an operation of said toner conveying means is varied during said toner replenish model, wherein said toner conveying device comprises:

a pipe forming a toner conveying path and a coil disposed in said pipe and movable to exert a conveying force on the toner toward a downstream side in a direction of toner conveyance.

19. The apparatus as claimed in claim 18, wherein at least part of said pipe is provided with a higher flow passage limiting ability than another part of said pipe.

20. The apparatus as claimed in claim 18, further comprising:

sensing means for sensing an amount of the toner remaining in the toner conveying path, wherein the toner replenish mode is ended when said means for sensing senses a predetermined amount of the toner remaining in said toner conveying path.

21. The apparatus as claimed in claim 18, further comprising:

time counting means for counting a duration of the toner replenish mode, wherein the toner replenish mode is ended when said counting means counts a predetermined period of time.

22. The apparatus as claimed in claim 18, wherein:

said toner container further comprises a memory for outputting data relating to said toner container, and a data processor is mounted on the body of said apparatus for reading said data.

23. The apparatus as claimed in claim 22, further comprising:

means for varying an operation of said toner conveying means during the toner replenish mode in accordance with the data in said memory.

* * * * *

UNITED STATES PATENT AND TRADEMARK OFFICE

CERTIFICATE OF CORRECTION

PATENT NO. : 7,398,038 B2
APPLICATION NO. : 10/667301
DATED : July 8, 2008
INVENTOR(S) : Tsuda et al.

It is certified that error appears in the above-identified patent and that said Letters Patent is hereby corrected as shown below:

On the title page, Item (30), the Foreign Application Priority Data is missing. Add Item (30) should read:

-- (30) Foreign Application Priority Data

September 24, 2002 (JP) ..... 2002-276466
August 12, 2003 (JP) ..... 2003-292151 --

Signed and Sealed this

Ninth Day of September, 2008

JON W. DUDAS
*Director of the United States Patent and Trademark Office*